United States Patent [19]

Corain

[11] 4,390,044

[45] Jun. 28, 1983

[54] RECIPROCATING DEVICE FOR INCREASING THE WEFT DENSITY IN CLOTH WEAVE FABRICS

[75] Inventor: Luciano Corain, Venice, Italy

[73] Assignee: Nuovo Pignone S.p.A., Florence, Italy

[21] Appl. No.: 204,230

[22] Filed: Nov. 5, 1980

[30] Foreign Application Priority Data

Nov. 26, 1979 [IT] Italy ..... 27545 A/79

[51] Int. Cl.[3] ..... D03D 49/00

[52] U.S. Cl. ..... 139/98; 139/115

[58] Field of Search ..... 139/97, 98, 114, 115

[56] References Cited

U.S. PATENT DOCUMENTS 630,347 8/1899 Hammond ..... 139/98

2,562,838 7/1951 Winslow ..... 139/98

FOREIGN PATENT DOCUMENTS 455389 10/1936 United Kingdom ..... 139/115

687080 2/1953 United Kingdom ..... 139/98

*Primary Examiner*—Henry Jaudon

*Attorney, Agent, or Firm*—George P. Hoare, Jr.

[57] ABSTRACT

Mechanical device disposed behind the heddle frames of a loom for increasing the weft density in cloth weave fabrics, constituted by three parallel rollers situated horizontally at the vertices of a triangle, of which the rear roller separates the two equal sets of warp yarns while the other two front rollers are located very close together and act as an outlet guide for said two equal sets of warp yarns. The three rollers are rigid at their ends with two lateral support plates which are made to reciprocate, by means of connecting rods connected eccentrically to the loom drive shaft, about a horizontal rotational axis which lies in the center plane of the shed formed by said two sets of warp yarns, and passes in proximity to the two front thread guide rollers and at an equal distance therefrom. The three rollers are connected rigidly together by intermediate support plates.

2 Claims, 2 Drawing Figures

RECIPROCATING DEVICE FOR INCREASING THE WEFT DENSITY IN CLOTH WEAVE FABRICS

This invention relates to a mechanically simple and robust reciprocating device of small overall size which enables the weft density in cloth weave fabrics to be increased accurately and uniformly.

A cloth weave fabric is obtained by dividing the warp yarns into two equal sets by means of the heddle frames of the loom, to form with said two equal sets of warp yarns a "shed" into which a weft yarn is inserted, the loom reed beating said inserted weft yarn against the edge of the fabric under formation and interlacing the two said sets of warp yarns, by exchanging the position of said heddle frames, in order to lock said inserted weft yarn into position.

In a fabric of this type, the two said sets of warp yarns become interlaced with the weft yarns in respective opposite directions, by wrapping them alternately from the bottom and from the top, and said weft yarns become disposed practically side-by-side in the same plane. The weft density of said fabric, i.e. the number of weft yarns which can be inserted per unit length of the fabric, is thus governed by the count and elasticity of the weft yarn, and by the tension of the warp yarns, and can obviously not exceed a certain limit corresponding to the number of weft yarns which can be arranged side-by-side pressed against each other.

On the other hand, for particular requirements especially in industrial applications, cloth weave fabrics are often required having a high weft density, to make said fabrics heavy, compact, resistant to permeation by fluids etc. At the present time, in order to increase the weft density in cloth weave fabrics beyond said limit, methods are used which act on the tension of the warp yarns. More specifically, each of said two equal sets of warp yarns alternately receives a tension variation relative to the other set.

In other words, the tension of one set of warp yarns is increased while simultaneously the tension of the other set is decreased alternately, so that when the tension of the warp yarns of this latter set is slackened, they are able to wrap around the weft yarns to a greater degree, with the result that said weft yarns become disposed in different planes, with one weft yarn partially superposing the previous one, so increasing the weight of the fabric per unit of area and its compactness. Said tension variation is generally obtained mechanically by making said two sets of warp yarns alternately pass through paths of different lengths, so that the tension of the set subjected to the greater path is increased, and vice versa. In the state of the art, mechanical devices are already known for varying the length of the paths of said two sets of warp yarns, and thus their tension.

One of said known mechanical devices is constituted substantially by a pair of horizontal parallel rollers which are situated in the rear part of the loom behind the heddle frames, and act as elements for separating said two sets of warp yarns, which are respectively passed over the first and under the second roller and vice versa. The two rollers are rigidly connected together by two arms pivoted at their centre line on the fixed loom framework, and connected eccentrically by connecting rods to the loom drive shaft. In this manner, rotation of the loom drive shaft causes the pair of rollers to reciprocate about said pivots firstly in one direction and then in the other, so that they thus become disposed almost vertically one on the other to alternately create a greater path for the two sets of warp yarns, thus varying the tension in said sets.

Although this known reciprocating device is of doubtless simplicity and mechanical strength, and is of small overall size, which allows it to be installed on the loom in the most suitable technical position, it however has the very serious drawback of not increasing the tension to an equal extent for the two sets of warp yarns. In other words, whereas one set of warp yarns is stretched by the device to a certain tension value during the beating of a weft yarn, the other set of warp yarns is stretched to a greater tension than the preceding during the beating of the next weft yarn. Thus the tension by which the warp yarns of the two sets are stretched during two successive weft beating operations varies.

This drawback is due substantially to the fact that at each two successive weft beats, the two sets of warp yarns cross each other at the outlet of the device as a result of the change in position of the heddle frames, because of which the set of warp yarns which is stretched when its yarns are crossed with those of the other set has to travel through a path greater than that which the other set has to travel through, whereas in the next weft beating operation, this latter set is stretched when the two sets of warp yarns are not crossed with each other, and said greater path, which consequently determines greater tensioning of one set of warp yarns relative to the other, is greater the greater the possible distance between the two sets of warp yarns where they leave the device, i.e. the greater the distance between the outside edges of the two reciprocating rollers. On the other hand, in the known reciprocating device, said distance between the rollers cannot be nullified because of the diameter of the rollers themselves, which cannot be reduced below certain limits for obvious reasons of device rigidity, because of which said known device generates greater tension in one set of warp yarns relative to the other during two successive weft beating operations, giving rise to a greater resilient backward thrust on the inserted weft yarn which thus becomes positioned differently from that previously inserted, so that the produced fabric does not have the required characteristics over its entire length.

Furthermore, said greater tension reduces the capacity of the device for increasing the weft density, in that it approaches to a greater degree or indeed reaches the strength limit of the warp yarns.

In a further mechanical device known to the state of the art, four fixed parallel rollers are used disposed horizontally at the vertices of a quadrilateral and situated in the rear of the loom behind the heddle frames, the only purpose of which is to guide the two said sets of warp yarns at the inlet and outlet.

Said sets are separated by a fifth horizontal roller which is mobile vertically within the system of said four rollers, and which on being moved alternately upwards and downwards causes a variation in the path and thus in the tension of the two said sets of warp yarns.

This latter known device does not show the drawback described in the preceding case, in that its two fixed outlet rollers can now be located very close together, because of which said crossing of the two sets of warp yarns caused by reversal of the frames for every two successive weft beating operations, does not in practice alter the paths of the two sets placed alternately under tension, and thus does not produce different tensions for the two sets of warp yarns. However, it has other drawbacks due substantially to its constructional complexity and its overall dimensions, and also to its limited rigidity in that the mobile roller which has to resist the bending force exerted on it by the set of warp yarns placed under tension cannot be connected rigidly to the fixed rollers. The object of the present invention is to obviate the drawbacks of said known devices while preserving their merits, and to thus provide a new mechanical device for increasing the weft density in cloth weave fabrics which is of the reciprocating roller type, and is thus mechanically simple and robust and of small overall dimensions, and which does not cause variations in the tension under which the warp yarns of the two sets of warp yarns are alternately stretched during two successive weft beating operations.

According to one characteristic of the present invention, this is substantially attained by using three parallel rollers situated horizontally at the vertices of a triangle, of which the rear roller separates the two equal sets of warp yarns while the other two front rollers are located very close together and act as an outlet guide for said two sets of warp yarns, said rollers being rigid at their ends with two lateral support plates hinged to the fixed loom framework on a horizontal axis lying on the centre plane of the shed formed by said two equal sets of warp yarns and passing in proximity to said two front thread guide rollers and at an equal distance therefrom, and being made to reciprocate about said horizontal axis by two connecting rods which eccentrically connect said lateral plates to the loom drive shaft.

In this manner, by reciprocating the system by rotating said rear separator roller upwards or downwards about said horizontal axis, a greater tension is impressed alternately on the two sets of warp yarns. Furthermore, the presence of the two front thread guide rollers disposed very close together make the paths for the two sets of warp yarns practically identical when these are tensioned alternately, so ensuring that these latter are always subjected to the same tension. Moreover, the small overall size and constructional simplicity of the device are immediately apparent, its rigidity and bending strength being now able, according to a further characteristic of the invention, to be further increased by connecting together said three rollers by intermediate support plates.

The invention is described hereinafter with reference to the accompanying drawings which show a preferred embodiment thereof, given by way of non-limiting example in that technical or constructional modifications can be made thereto without leaving the scope of the present invention, and in which.

Figure 1:
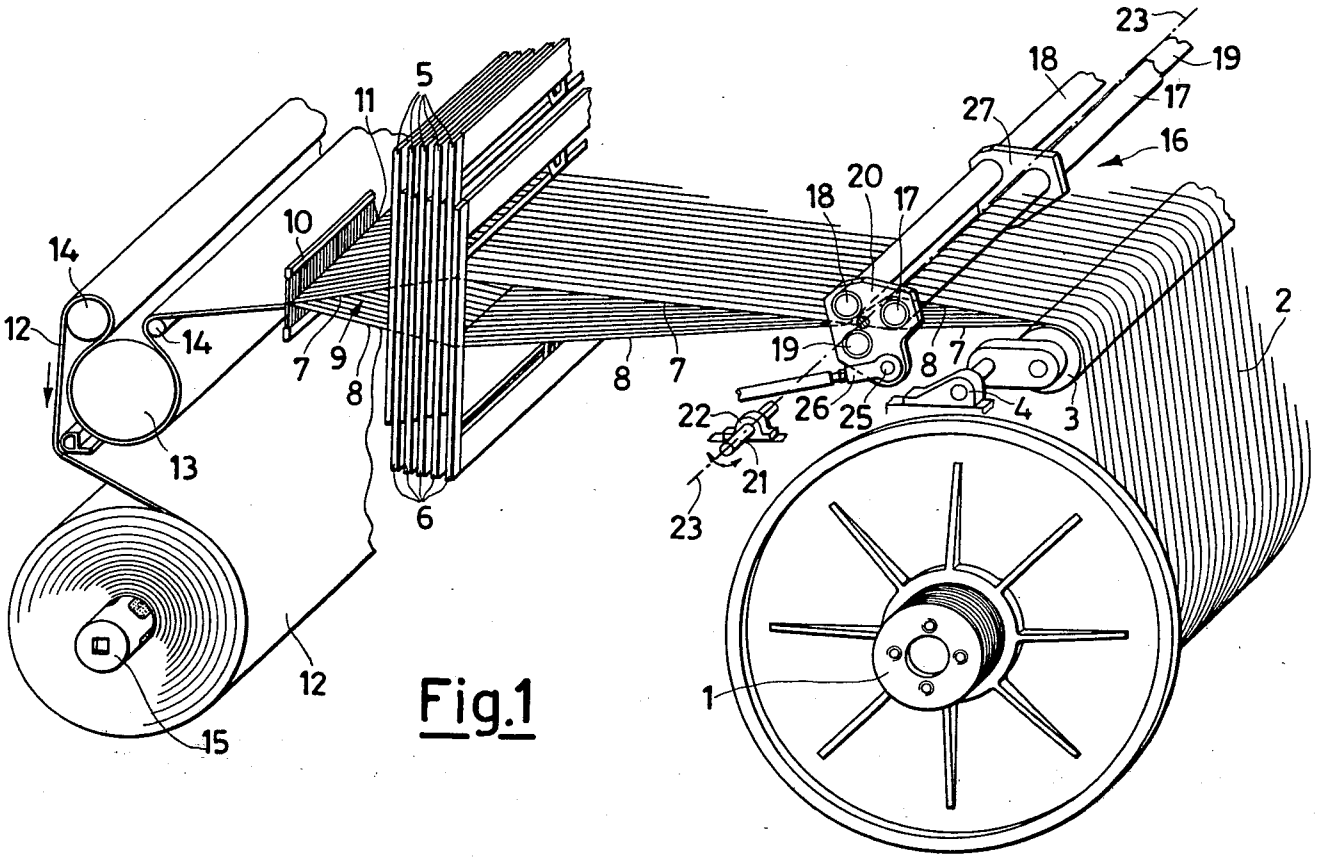
FIG. 1 is a partial diagrammatic perspective view of a loom on which the mechanical device for increasing the weft density according to the invention is mounted.

With reference to the figures, the reference numeral 1 indicates the loom beam which supplies the warp yarns 2 which, guided by the slide roller 3 supported in an angularly adjustable position by a fixed part 4 of the loom, are alternately passed through the heddle eyes (not shown in the figure) of two sets of heddle frames 5 and 6 respectively, disposed vertically in two different positions and exchangeable with each other, so that they become divided into two equal sets of warp yarns 7 and 8 respectively. Said two sets of warp yarns 7 and 8 thus form a shed 9 into which a weft yarn (not shown in the figure) is inserted and is then beaten by the reed 10 against the edge 11 of the fabric under formation, and is locked there in position by said two sets of warp yarns 7 and 8 being made to cross each other by mutually exchanging the positions of the two said sets of heddle frames 5 and 6. The cloth weave fabric 12 thus formed is then dragged by the piece dragging roller 13 and is passed over guide rollers 14 to be wound on the loom beam 15. The mechanical device 16 for increasing the weft density is mounted in the rear part of the loom, between said heddle frames 5 and 6 and said beam 1, and is substantially constituted by three parallel rollers 17, 18 and 19 respectively, situated horizontally at the vertices of a triangle and disposed orthogonally to the warp yarns of the two sets 7 and 8.

The rear roller 17 acts as a separator element in that it separates from each other the two equal sets of warp yarns 7 and 8 which are passed respectively over and under said roller, while the other two front rollers 18 and 19 are located very close together and act as an outlet guide for said two equal sets of warp yarns 7 and 8 which are passed through said front rollers. The ends of the three rollers 17, 18 and 19 are rigidly fixed to two lateral support plates 20 (only one lateral support plate is visible in the figures), which are hinged by rotation pins 21 rigid with said plates, to a fixed loom framework 22 about a horizontal axis of rotation 23 lying in the centre plane 24 (see FIG. 2) of the shed 9 and passing in proximity to the two front thread guide rollers 18 and 19 at an equal distance therefrom.

The ends of two connecting rods 26 (only one is visible in the figures) are hinged by pins 25 to the two lateral support plates 20, their other ends being eccentrically connected to the loom drive shaft (not shown in the figures) in known manner such that the rotation of said drive shaft causes the two plates 20 and consequently the whole device to reciprocate firstly in one direction and then in the other about said horizontal rotational axis 23. Finally, the three rollers 17, 18 and 19 are rigidly connected together by intermediate support plates 27 (only one intermediate plate is visible in FIG. 1) disposed vertically parallel to said lateral plates 20.

The method of operation of the device 16 is immediately apparent.

Figure 2:
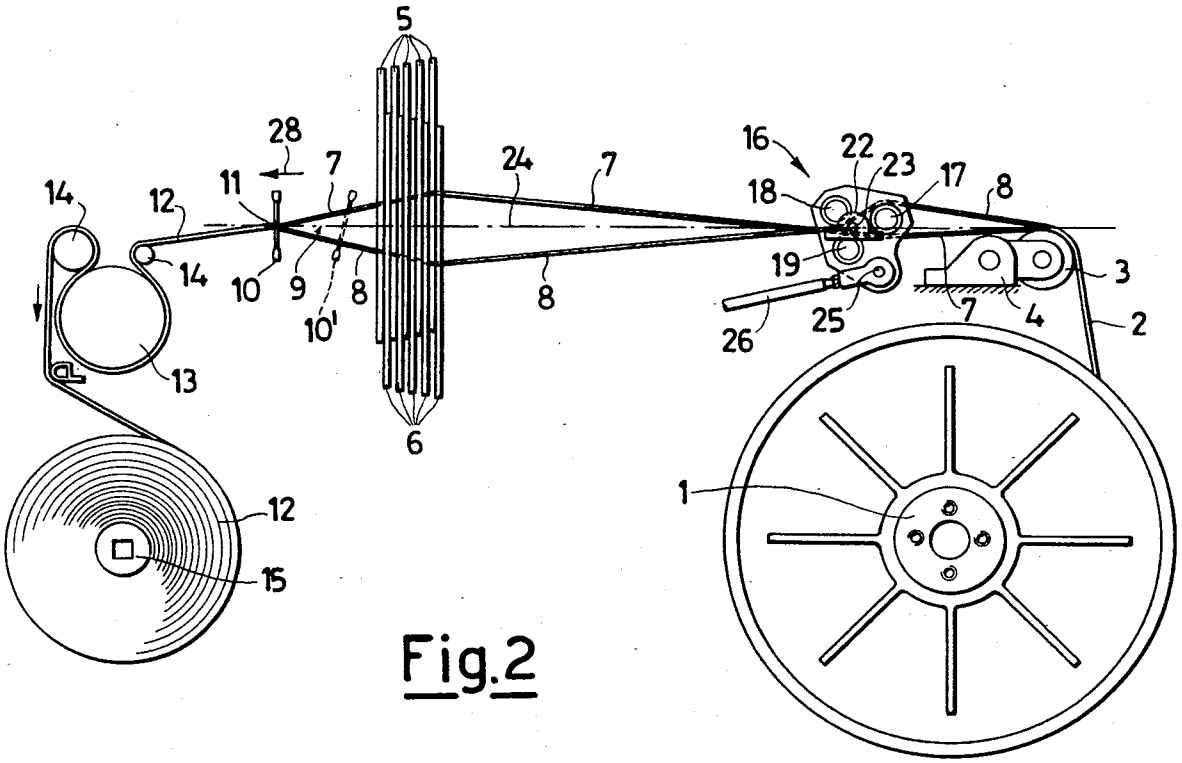
FIG. 2 is a side view of the loom of FIG. 1.

In the rest position, i.e. with the heddle frames 5 and 6 in their end positions in order to create a completely open shed 9 and the reed in its withdrawn position indicated with dashed lines by 10' in FIG. 2, the front thread guide rollers 18 and 19 of the device are disposed one on the other vertically and symmetrically about said centre plane 24 of the shed 9, while the rear separator roller 17 has its axis coplanar with said centre plane 24. Thus under these conditions, the difference in tension between the two equal sets of warp yarns 7 and 8 is zero, i.e. the two sets of warp yarns 7 and 8 are subjected to equal tension as their strokes are equal (see FIG. 2 in this respect).

However, when the reed beats a weft yarn and is thus rotated by the loom drive shaft in the direction of the arrow 28 from the position 10' shown in dashed lines to the beating position 10 shown in full lines, and the heddle frames 5 and 6 simultaneously begin their exchange of position, the device for increasing the weft density 16 reciprocates anti-clockwise about its axis of rotation 23 by the effect of the rotation of the loom drive shaft, because of which its rear roller 17 rotates upwards to progressively increase the path and consequently the tension of the overlying set of warp yarns 7 (see FIG. 1 specifically), while the tension in the underlying set of warp yarns 8 simultaneously diminishes, this enabling the weft density in the fabric to be increased, as already stated. When the heddle frames 5 and 6 have completed their exchange of position to cross the two sets of warp yarns 7 and 8 over each other, and the reed has returned to its withdrawn position 10', the device 16 reassumes said rest position at which the difference in tension between the two sets of warp yarns 7 and 8 is again zero, and the only difference is given by the fact that those portions of the two sets of warp yarns 7 and 8 lying between the heddle frames 5 and 6 and the device 16 are now crossed over each other, but without them undergoing any variation in path. At this point, the heddle frames 5 and 6 begin their reverse exchange of position, and the reed begins to beat the next weft yarn, by rotating in the direction of the arrow 28 from the withdrawn position 10' to the beating position 10, both driven by the loom drive shaft which impresses on the device 16 a reciprocating movement having an amplitude equal to the preceding one but in the opposite direction, i.e. in a clockwise direction, which, by rotating the rear roller 17 downwards, determines a progressive increase in tension for the underlying set of warp yarns 8 and a simultaneous progressive decrease in tension for the overlying set of warp yarns 7. Thus the tension difference between the two sets of warp yarns 7 and 8 which are now crossed over each other is applied in the opposite manner to the preceding case, and in addition the two sets of warp yarns 7 and 8 are alternately stretched to the same tension value during two successive weft beating operations, in that their paths remain unaltered, as is apparent from the figures. Finally, when said reverse position exchange of the heddle frames 5 and 6 terminates, so that the two sets of warp yarns 7 and 8 are returned from their crossed position to their symmetrical position about the centre plane 24 of the shed 9, the device 16 again assumes said rest position, and is thus in the initial state shown in FIG. 2, from which the cycle heretofore described begins again.

I claim:

1. In a loom construction in which the warp yarns originating from a beam disposed in the rear part of the loom construction are divided by the heddle frames into two equal sets and which at their front form a shed into which a weft yarn is inserted and is subsequently beaten by a reed, the improvement of a mechanical device for increasing the weft density in cloth weave fabrics produced by said loom construction, said device being mounted in the rear part of the loom construction between said heddle frames and said beam and comprising a pair of parallel forward rollers spaced one above the other in a horizontally disposed relationship and a rear parallel roller rearwardly spaced in a horizontally disposed relationship at the vertices of a triangle formed by the three rollers, said rear roller separating the two equal sets of warp yarns and the pair of forward rollers being positioned in close relationship to one another and function as an outlet guide for the two equal sets of warp yarns, each of said three rollers being rigidly connected at their respective ends to laterally-spaced vertically disposed support plate means, rotational pin means horizontally connected to said loom construction and to support plates to permit the support plate means and the three rollers to rotate about a horizontal axis of rotation, said pin means being connected to said support plates at a point equidistant from the two forward rollers and between the two forward rollers and the rear roller, and drive means connected to said support plate means to reciprocate said support means and said three rollers about the horizontal axis of rotation formed by said pin means.

2. A mechanical device as claimed in claim 1, wherein said three rollers are also rigidly connected together by intermediate support plates.

* * * * *